US006718040B1

(12) United States Patent
Nakamura et al.

(10) Patent No.: US 6,718,040 B1
(45) Date of Patent: Apr. 6, 2004

(54) TRANSFORMER, LOUDSPEAKER DEVICE, LOUDSPEAKER NETWORK, AND LOUDSPEAKER SYSTEM

(75) Inventors: Takeshi Nakamura, Uji (JP); Takayuki Kaneko, Kyoto (JP); Yutaka Murai, Nagaokakyo (JP); Takao Mouri, Osaka-fu (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 664 days.

(21) Appl. No.: 09/593,376

(22) Filed: Jun. 15, 2000

(30) Foreign Application Priority Data

Jun. 18, 1999 (JP) ..... 11-172185
Mar. 9, 2000 (JP) ..... 2000-064948

(51) Int. Cl.[7] ..... H04R 29/00
(52) U.S. Cl. ..... 381/59; 381/116; 336/192
(58) Field of Search ..... 381/407, 408, 381/409, 410, 191, 150, 174, 192, 116, 117, 111, 400, 59, 402, 181; 336/198, 208, 192, 222

(56) References Cited

U.S. PATENT DOCUMENTS 4,461,931 A * 7/1984 Peters ..... 179/111
4,845,776 A * 7/1989 Bittencourt ..... 381/190

FOREIGN PATENT DOCUMENTS

EP 0 264 110 A1 4/1988
EP 0883326 A2 * 12/1998
JP 58-034699 * 1/1983

* cited by examiner

*Primary Examiner*—Duc Nguyen
*Assistant Examiner*—Lun-See Lao
(74) *Attorney, Agent, or Firm*—Keating & Bennett, LLP

(57) ABSTRACT

A transformer includes a bobbin having a cavity, a primary winding wound around the bobbin, and a secondary winding wound around the bobbin and magnetically coupled with the primary winding. In the transformer, at least one of the primary winding and the secondary winding is divided into at least two portions which include a portion wound at an inside region of the transformer and a portion wound at an outside region of the transformer. Also, at least a portion of the other one of the primary winding and the secondary winding is wound between said at least two portions obtained by dividing the one of the primary winding and the secondary winding, and at least a portion of the cavity of the bobbin is used as a space to dispose another member therein.

12 Claims, 6 Drawing Sheets

TRANSFORMER, LOUDSPEAKER DEVICE, LOUDSPEAKER NETWORK, AND LOUDSPEAKER SYSTEM

BACKGROUND OF THE INVENTION

1. Field of the Invention

The present invention relates to transformers, loudspeaker devices, loudspeaker networks, and loudspeaker systems, and more specifically relates to a transformer included in a piezoelectric loudspeaker, and to a loudspeaker device, a loudspeaker network, and a loudspeaker system that include the above-described transformer.

2. Description of the Related Art

A transformer for a conventional piezoelectric loudspeaker is constructed such that a primary winding and a secondary winding are wound around a bobbin and a core is inserted into the bobbin.

In the above-described transformer for the conventional piezoelectric loudspeaker, the transformer is expensive as well as heavy due to the use of the core. Accordingly, the removal of the core has been contemplated to produce an inexpensive and light-weight transformer. However, the removal of the core decreases the magnetic coupling strength between the primary winding and the secondary winding. Moreover, to reduce the size of the piezoelectric loudspeaker, it is desirable to provide another member, such as a portion of the loudspeaker, within the above-described transformer of the conventional piezoelectric loudspeaker. These points also apply to a loudspeaker device, a loudspeaker network, and a loudspeaker system that include the transformer for the conventional piezoelectric loudspeaker.

SUMMARY OF THE INVENTION

In order to overcome the problems described above, preferred embodiments of the present invention provide an inexpensive, compact, and lightweight transformer which has strong magnetic coupling between a primary winding and a secondary winding, and which can hold another member therein.

Further, preferred embodiments of the present invention provide a loudspeaker device, a loudspeaker network, and a loudspeaker system which include a transformer that is inexpensive, compact, and lightweight, and that has strong magnetic coupling between a primary winding and a secondary winding, and which has another member disposed therein.

According to a first preferred embodiment of the present invention, a transformer including a bobbin having a cavity, a primary winding wound around the bobbin, and a secondary winding wound around the bobbin and magnetically coupled with the primary winding is provided. In the transformer, at least one of the primary winding and the secondary winding is divided into at least two portions which include a portion wound at the inside and a portion wound at the outside, at least a portion of the other one of the primary winding and the secondary winding is wound between said at least two portions obtained by dividing the one of the primary winding and the secondary winding, and at least a portion of the cavity of the bobbin is used as a space to accommodate another member therein.

According to another preferred embodiment of the present invention, a loudspeaker device includes a transformer as described in the previous paragraph, and a loudspeaker, connected to the transformer, and including a sound-producing body having a piezoelectric body. In the loudspeaker device, at least a portion of the loudspeaker is provided in the cavity of the bobbin.

In the loudspeaker device according to another preferred embodiment of the present invention, the loudspeaker has a horn for conducting sound waves transmitted from the sound-producing body, one end of the horn is inserted into the cavity of the bobbin, and the bobbin of the transformer is mounted on the horn.

According to another preferred embodiment of the present invention, a loudspeaker network includes a transformer having the features of the preferred embodiment described above and an impedance network connected to the transformer.

According to a further preferred embodiment of the present invention, a loudspeaker system includes a loudspeaker device according to a preferred embodiment described above, and a loudspeaker network according to the preferred embodiment described above. In the loudspeaker device, the transformer of the loudspeaker device includes the transformer of the loudspeaker network.

Since there is no core used in the transformer, the transformer is inexpensive as well as lightweight.

Furthermore, in the transformer according to preferred embodiments of the present invention, since at least one of the primary winding and the secondary winding is wound between at least two portions obtained by dividing the other one of the primary winding and the secondary winding, the magnetic coupling between the primary winding and the secondary winding of the transformer is stronger than a transformer constructed by winding the entire primary winding and the winding the entire secondary.

Also, in the transformer according to preferred embodiments of the present invention, since a portion of the cavity of the bobbin is used as a space for having another member disposed therein, another member, such as an end portion of the horn of the loudspeaker, can be disposed therein.

Other features, characteristics, arrangements and advantages of the present invention will become more apparent from the detailed description of preferred embodiments of the present invention with reference to the attached drawings.

DETAILED DESCRIPTION OF THE PREFERRED EMBODIMENTS

Figure 1:
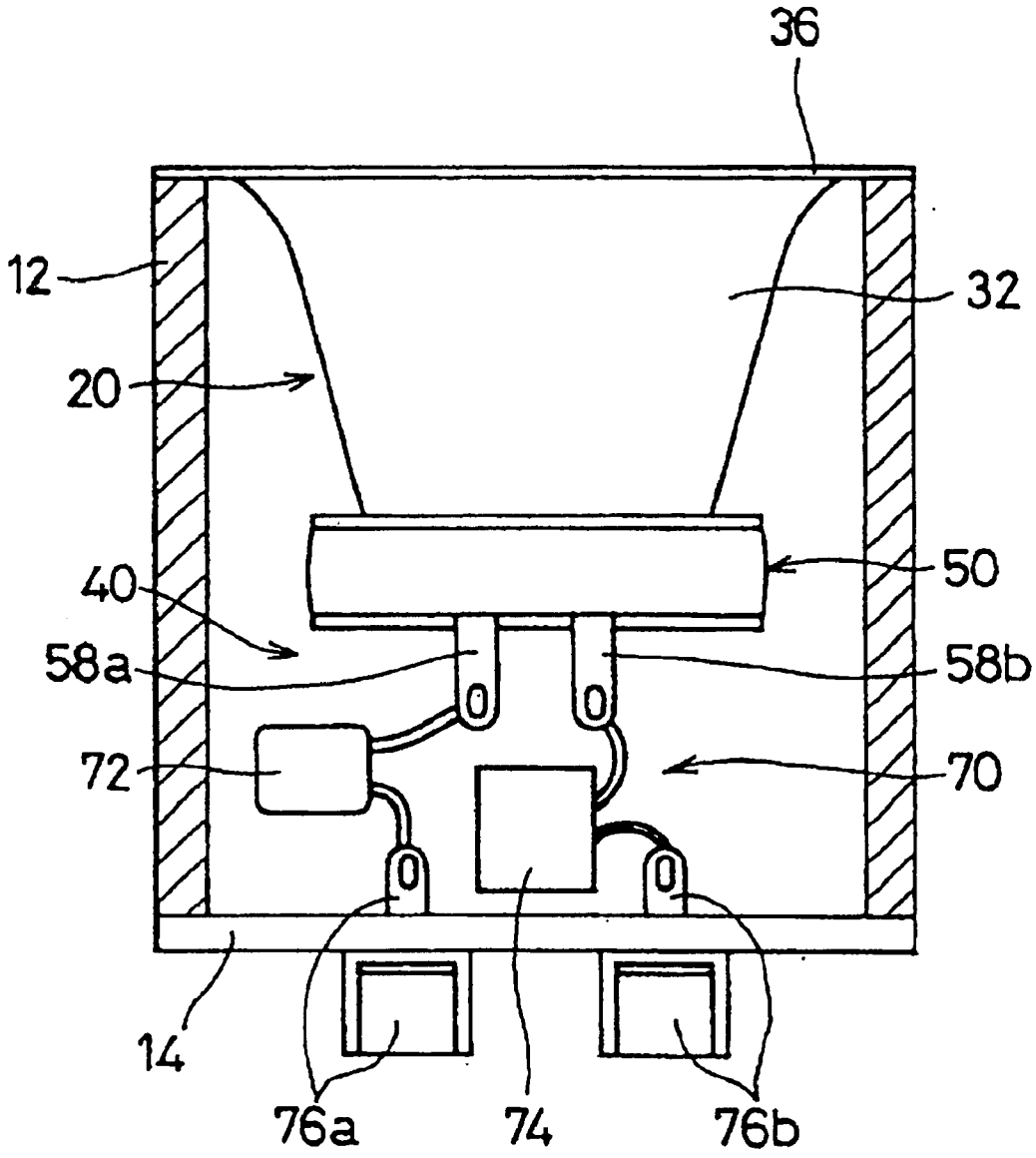
FIG. 1 is an illustration showing one example of a loudspeaker system according to a preferred embodiment of the present invention.
Figure 2:
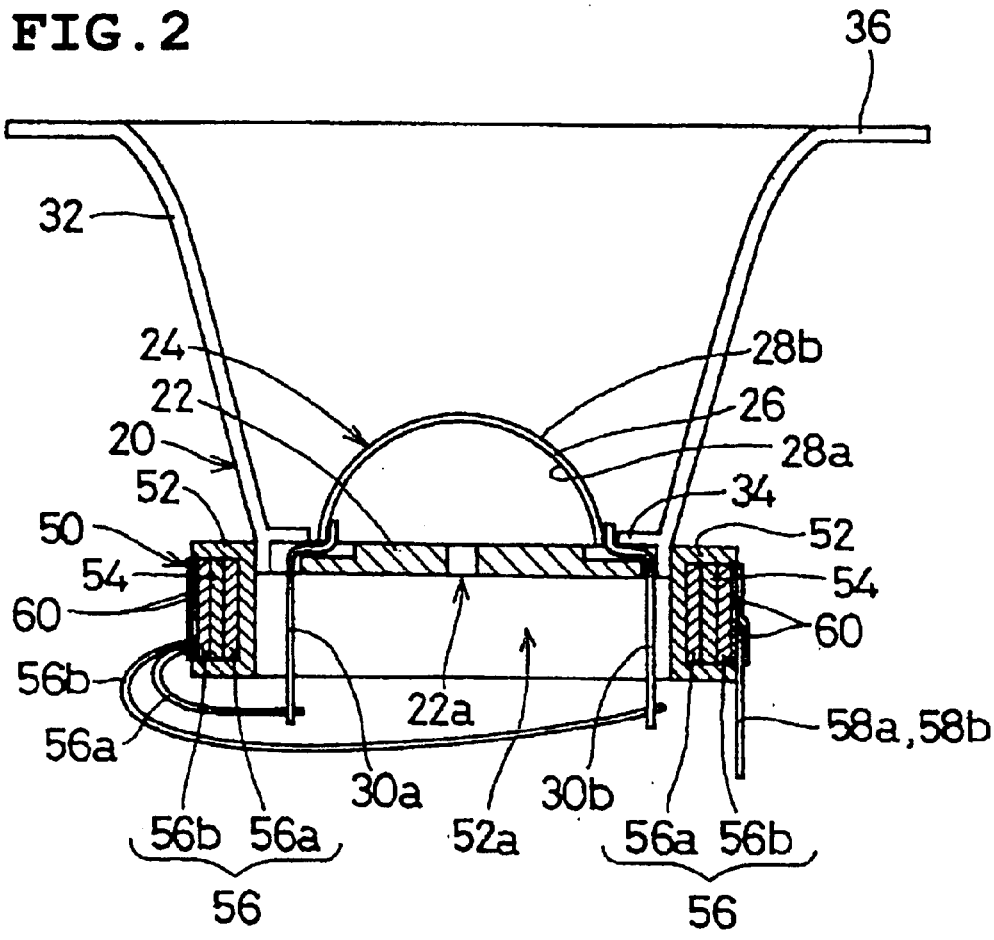
FIG. 2 is an illustration showing a loudspeaker device of the loudspeaker system shown in FIG. 1.

FIG. 1 is an illustration showing one example of a loudspeaker system according to a preferred embodiment of the present invention. FIG. 2 is an illustration showing a loudspeaker device of the loudspeaker system. A loudspeaker system 10 shown in FIG. 1 preferably includes a substantially cylindrical casing 12 made of synthetic resin, or other suitable material. One end of the casing 12 is open while the other end has a disk-shaped lid 14 adhered thereto.

Figure 3:
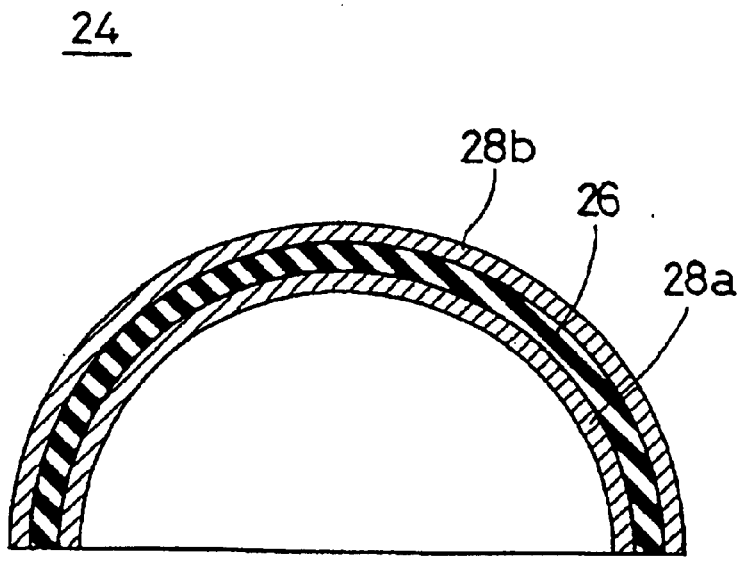
FIG. 3 is a sectional view showing a vibrator of a piezoelectric loudspeaker included in the loudspeaker system shown in FIG. 1.

The casing 12 has a piezoelectric loudspeaker 20 mounted therein as a tweeter. The piezoelectric loudspeaker 20 includes a disk-shaped supporting member 22 as shown in FIG. 2. A hole 22*a*, serving as a so-called "air vent" is provided at the approximate center of the supporting member 22. One major surface of the supporting member 22 has a substantially hemispherical vibrator 24 with a diameter of about 20 mm attached thereto. The vibrator 24 functions as a sound-producing body and includes a substantially hemispherical vibrating body 26 which is made of a piezoelectric material, such as a piezoelectric ceramic, or other suitable piezoelectric material, polarized in the thickness direction, as shown in FIG. 3. Electrodes 28*a* and 28*b* are provided on the internal surface and external surface of the vibrator 24, respectively.

As shown in FIG. 2, input terminals 30*a* and 30*b* each have one end thereof soldered to the electrodes 28*a* and 28*b* of the vibrator 24, respectively. Furthermore, a horn 32 made of a synthetic resin, or other suitable material, is mounted around the supporting member 22.

The horn 32 is configured so that the width thereof gradually increases from one end 34 towards the other end 36. The end 34 of the horn 32 includes a step and the other end 36 of the horn 32 includes a flange. The end 34 of the horn 32 is adhered to the surrounding of the supporting member 22, thus securing the input terminals 30*a* and 30*b* between the end 34 of the horn 32 and the surrounding of the support member 22, as shown in FIG. 2. The other end 36 of the horn 32 is adhered to one end of the casing 12 as shown in FIG. 1, and supports the piezoelectric loudspeaker 20 in the casing 12. In this piezoelectric loudspeaker 20, by inputting a signal across the input terminals 30*a* and 30*b*, the vibrator 24 vibrates, and a sound is produced from the horn 32.

Furthermore, the loudspeaker system 10 includes a loudspeaker network 40. The loudspeaker network 40 includes a transformer 50 and an impedance network 70.

As shown in FIG. 2, the transformer 50 includes a substantially cylindrical bobbin 52 made of a synthetic resin, or other suitable material. The bobbin 52 has a cavity 52*a* in the approximate center thereof. The nose of the end 34 of the horn 32 of the piezoelectric loudspeaker 20 is inserted into the cavity 52*a* of the bobbin 52. Thus, the bobbin 52 is fixedly adhered around the end 34 of the horn 32. In this case, not only the end 34 of the horn 32 but also the supporting member 22 of the piezoelectric loudspeaker 20 and middle portions of the input terminals 30*a* and 30*b* are provided in the cavity 52*a* of the bobbin 52. A primary winding 54 and a secondary winding 56 are wound around this bobbin 52. In this case, the secondary winding 56 is divided into two portions 56*a* and 56*b*. The portion 56*a* of the secondary winding 56, the primary winding 54, and the portion 56*b* of the secondary winding 56 are wound in that order around the bobbin 52, such that the primary winding 54 is sandwiched between portions 56*a* and 56*b* of the secondary winding 56. Furthermore, in the secondary winding 56, one end of the portion 56*a* is connected to the input terminal 30*a* of the piezoelectric loudspeaker 20, the other end of the portion 56*a* is connected to one end of the portion 56*b*, and the other end of the portion 56*b* is connected to the input terminal 30*b* of the piezoelectric loudspeaker 20. That is, the ends of the secondary winding 56 are connected to the corresponding input terminals 30*a* and 30*b* of the piezoelectric loudspeaker 20. The ends of the primary winding 54 are connected to corresponding terminals 58*a* and 58*b*. These terminals 58*a* and 58*b* are mounted via an insulating tape 60 on the portion 56*b* of the secondary winding 56.

As described above, the loudspeaker device is constructed by combining the piezoelectric loudspeaker 20 and the transformer 50.

As shown in FIG. 1, the impedance network 70 includes a capacitor 72 of about 2 $\mu$F and a resistor 74 of about 6.7 k$\Omega$, or other suitable capacitance and resistance. One end of the capacitor 72 and one end of the resistor 74 are connected to the two terminals 58*a* and 58*b* of the transformer 50, respectively. The other end of the capacitor 72 and the other end of the resistor 74 are connected to two external terminals 76*a* and 76*b*, respectively. These external terminals 76*a* and 76*b* are mounted so as to penetrate the lid 14 of the casing 12.

Figure 4:
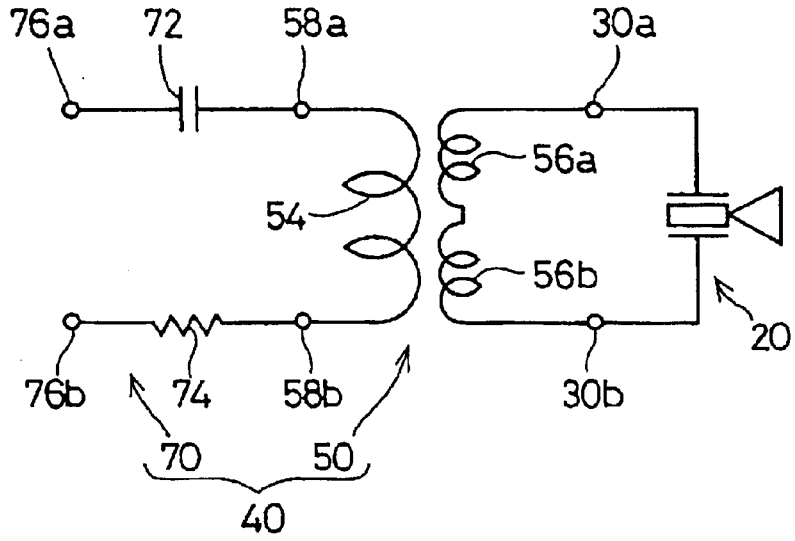
FIG. 4 is a circuit diagram of the loudspeaker system shown in FIG. 1.

Therefore, this loudspeaker system 10 includes a circuit shown in FIG. 4.

Since there is no core provided in the transformer 50 of the loudspeaker network 40, the loudspeaker system 10 is inexpensive as well as lightweight.

Since the primary winding 54 is wound between the two portions 56*a* and 56*b* obtained by dividing the secondary winding 56 of the transformer 50 of this loudspeaker system 10, the magnetic coupling between the primary winding 54 and the secondary winding 56 is stronger than the magnetic coupling between a primary winding and a secondary winding of a transformer constructed by winding the primary winding and the secondary winding in that order, such that the primary winding is not sandwiched between two portions of the secondary winding.

Furthermore, in this loudspeaker system 10, the cavity 52*a* of the bobbin 52 of the transformer 50 is effectively used as a space for disposing the supporting member 22 and the input terminals 30*a* and 30*b* of the piezoelectric loudspeaker 20, and the end 34 of the horn 32.

Figure 5:
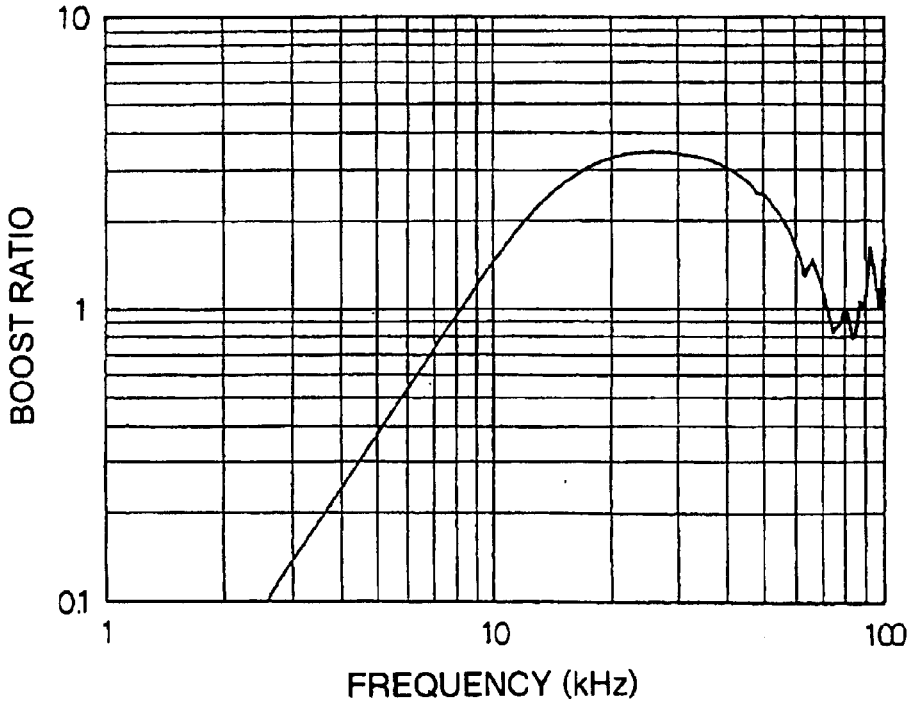
FIG. 5 is a graph showing frequency characteristics of the boost ratio of a loudspeaker network used in the loudspeaker system shown in FIG. 1.

In this loudspeaker system 10, as shown by frequency characteristics of the boost ratio of the loudspeaker network 40 in FIG. 5, the boost ratio is high in the high frequency band. Accordingly, this loudspeaker system 10 produces an outstanding tweeter because high sound pressure is obtained from the piezoelectric loudspeaker 20 in the high frequency band.

Figure 6:
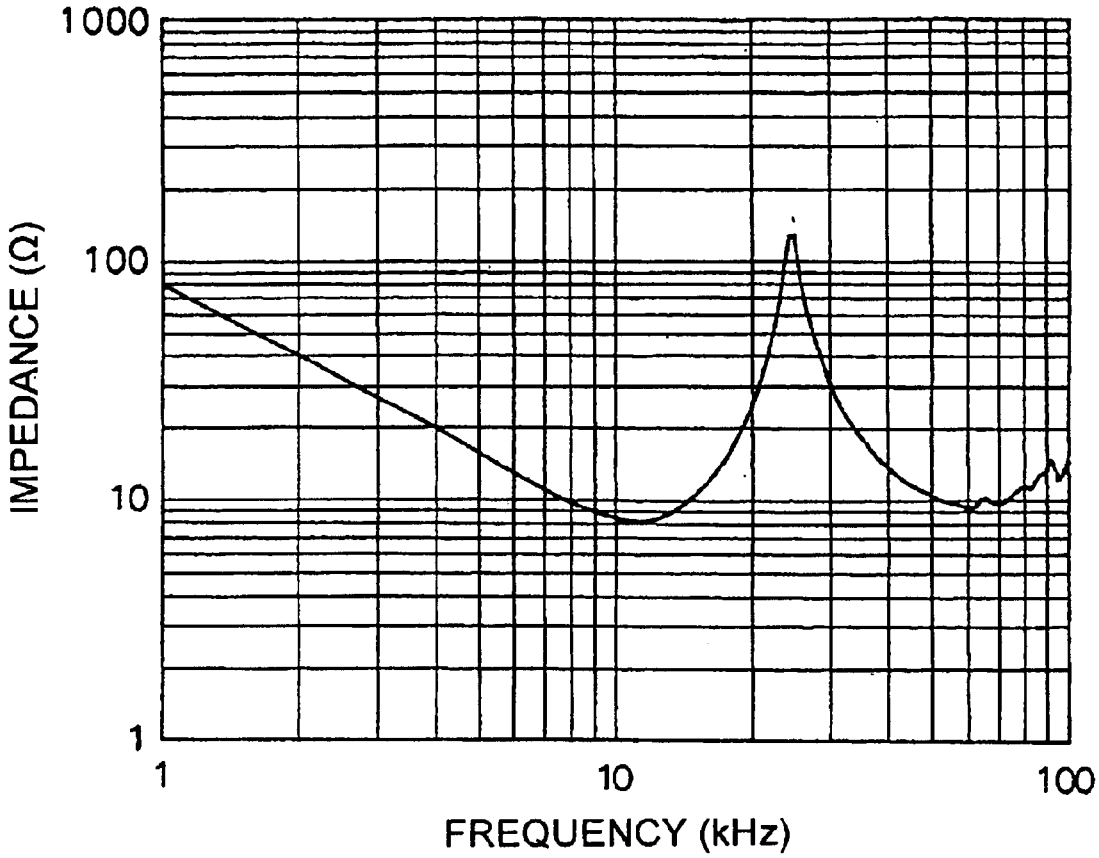
FIG. 6 is a graph showing frequency characteristics of the impedance of the loudspeaker network used in the loudspeaker system shown in FIG. 1.
Figure 7:
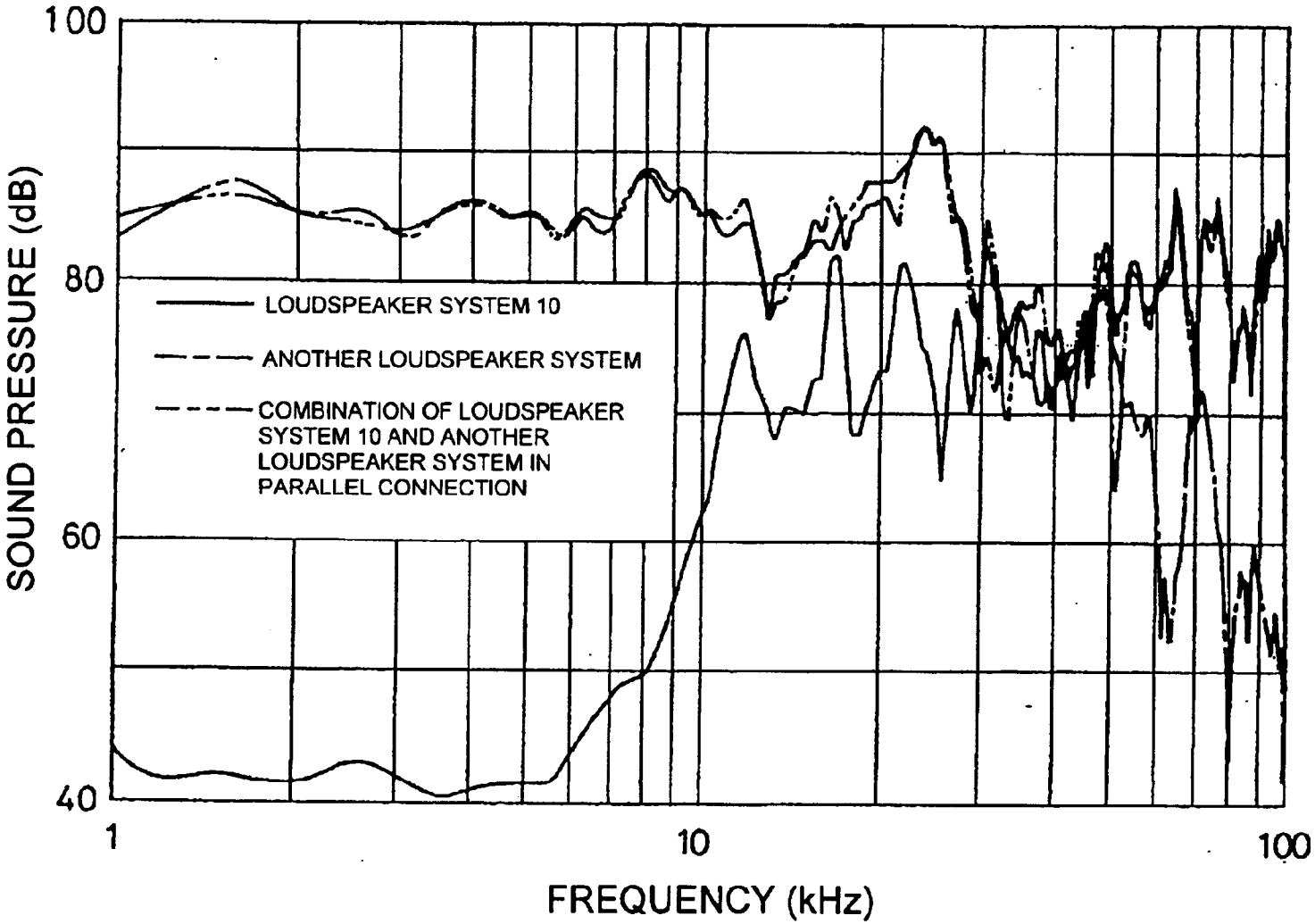
FIG. 7 is a graph showing frequency characteristics of the sound pressure of the loudspeaker system shown in FIG. 1.

In this loudspeaker system 10, the frequency characteristics of the impedance of the loudspeaker network 40 as shown in FIG. 6 illustrate that the impedance is high at portions of the low frequency band. Accordingly, when this loudspeaker system 10 is connected in parallel with another loudspeaker, such as a woofer, this loudspeaker system 10 performs very well because it does not practically affect a signal in the low frequency band. Frequency characteristics of sound pressures concerning this loudspeaker system 10, another loudspeaker system, and the loudspeaker system obtained by connecting these systems in parallel are shown in FIG. 7. According to the frequency characteristics shown in FIG. 7, the other loudspeaker system does not have a very high sound pressure in the high frequency band. However, by connecting the loudspeaker system 10 in parallel with the other loudspeaker system, the sound pressure is increased in the high frequency band while it is not substantially affected in the low frequency band.

In this loudspeaker system 10, the end 34 of the horn 32 of the piezoelectric loudspeaker 20 is a node of the piezoelectric loudspeaker 20. Since the loudspeaker device is constructed by mounting the transformer 50 at the end 34, a loudspeaker device having a compact structure is produced, in which the transformer 50 does not substantially affect the vibration of the piezoelectric loudspeaker 20 and the space of the air-core unit of the transformer 50 (the cavity 52*a*) can be effectively utilized.

In this loudspeaker system 10, since a core is not used in the transformer 50, the inductance of the transformer 50 is greatly reduced, and the desired inductance is obtained in the high frequency band. Accordingly, the transformer 50 is well-suited for use in the loudspeaker network 40.

Figure 8:
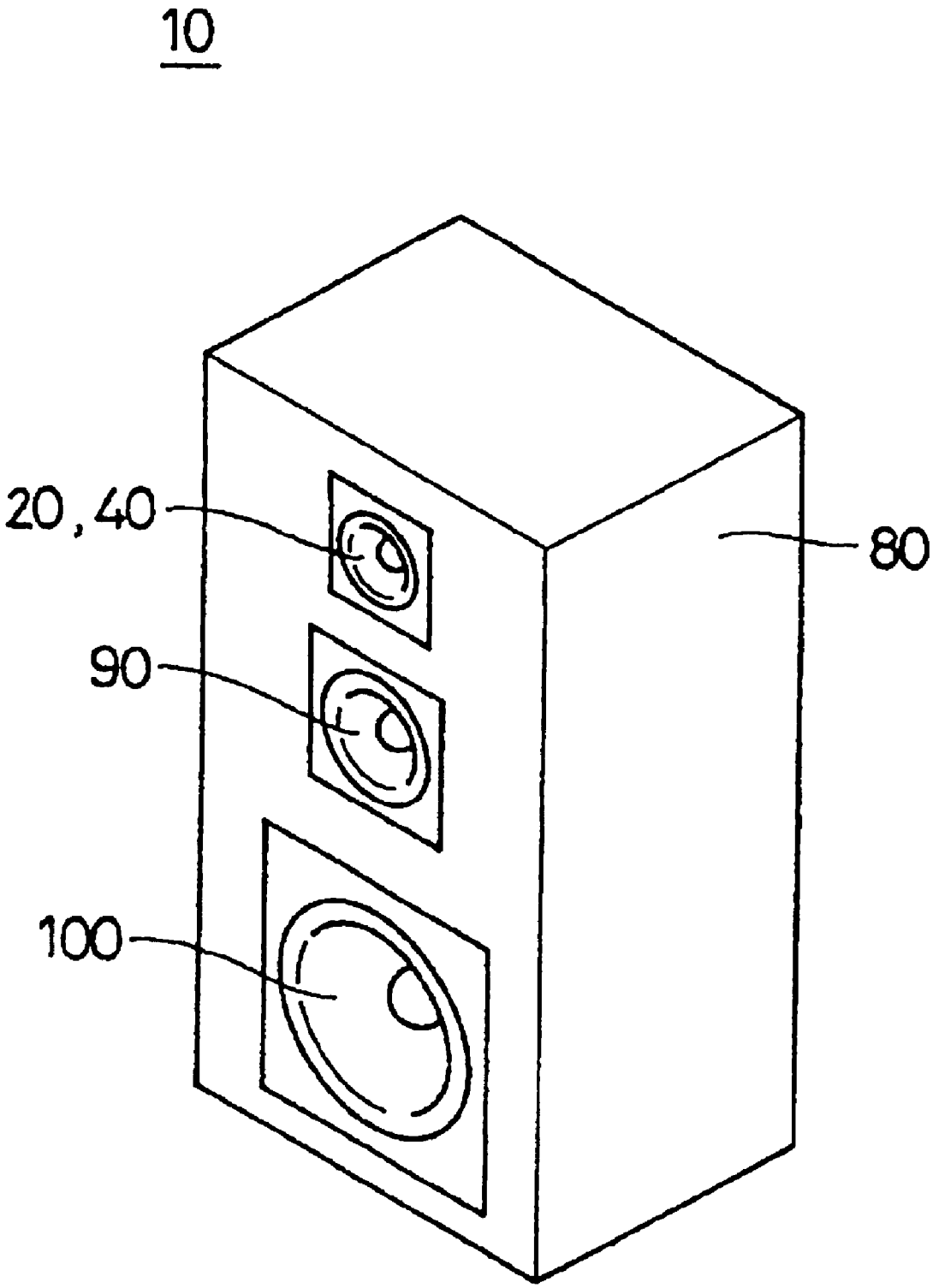
FIG. 8 is a perspective view of another preferred embodiment of a loudspeaker system according to the present invention.

FIG. 8 is a perspective view showing another preferred embodiment of the loudspeaker system according to the present invention. A loudspeaker system 10 shown in FIG. 8 has the piezoelectric loudspeaker 20 and the loudspeaker network 40, along with a midrange 90 and a woofer 100, mounted in one casing 80.

In the above described loudspeaker system 10, unlike in the transformer 50 of the loudspeaker network 40 where the primary winding 54 is wound between the two portions 56*a* and 56*b* of the secondary winding 56, the secondary winding 56 can be wound between two portions of the primary winding 54. Alternatively, portions obtained by dividing each of the primary winding 54 and the secondary winding 56 into at least two portions may be alternately wound from among the primary winding portions and the secondary winding portions.

Although in the above-described loudspeaker system 10, the supporting member 22 and the input terminals 30*a* and 30*b* of the piezoelectric loudspeaker 20 and the one end of the horn 32 are provided within the cavity 52*a* of the bobbin 52 of the transformer 50, other members may also be disposed therein.

In the above-described loudspeaker system 10, although the impedance network 70 including the capacitor 72 and the resistor 74 is provided, another impedance network may be used.

In the above-described loudspeaker system 10, although the piezoelectric loudspeaker 20 is used, another type of loudspeaker may be used.

While the invention has been particularly shown and described with reference to preferred embodiments thereof, it will be understood by those skill in the art that the foregoing and other changes in form and details may be made therein without departing from the spirit of the invention.

What is claimed is:

1. A loudspeaker device comprising:

a transformer comprising:

a bobbin having a cavity;

a primary winding wound around said bobbin; and a secondary winding wound around said bobbin and magnetically coupled with said primary winding; wherein at least one of said primary winding and said secondary winding is divided into at least two portions which include a portion wound at an inside region of the transformer and a portion wound at an outside region of the transformer;

at least a portion of the other one of said primary winding and said secondary winding is wound between said at least two portions obtained by dividing the one of said primary winding and said secondary winding; and at least a portion of said cavity of said bobbin is used as a space to dispose another member therein; and a loudspeaker, connected to said transformer, and including a sound-producing body having a piezoelectric body; wherein at least a portion of said loudspeaker is provided in said cavity of said bobbin.

2. A loudspeaker device according to claim 1 wherein said loudspeaker includes a horn to conduct sound waves transmitted from said sound-producing body;

one end portion of said horn is inserted into said cavity of said bobbin; and said bobbin of said transformer being mounted on said horn.

3. A loudspeaker network comprising:

a transformer according to claim 1; and an impedance network connected to said transformer.

4. A loudspeaker system comprising:

a loudspeaker device including a transformer having a bobbin having a cavity, a primary winding wound around said bobbin, and a secondary winding wound around said bobbin and magnetically coupled with said primary winding, wherein at least one of said primary winding and said secondary winding is divided into at least two portions which include a portion wound at an inside region of the transformer and a portion wound at an outside region of the transformer, at least a portion of the other one of said primary winding and said secondary winding is wound between said at least two portions obtained by dividing the one of said primary winding and said secondary winding, and at least a portion of said cavity of said bobbin is used as a space to dispose another member therein, said loudspeaker device being connected to said transformer, and including a sound-producing body having a piezoelectric body, at least a portion of said loudspeaker is provided in said cavity of said bobbin; and an impedance network connected to said transformer.

5. A loudspeaker system according to claim 4, wherein said loudspeaker includes a horn to conduct sound waves transmitted from said sound-producing body, one end portion of said horn is inserted into said cavity of said bobbin, and said bobbin of said transformer being mounted on said horn.

6. A loudspeaker device comprising:

a transformer comprising:

a bobbin having a cavity;

a primary winding wound around said bobbin; and a secondary winding wound around said bobbin and magnetically coupled with said primary winding; wherein at least one of said primary winding and said secondary winding is divided into at least two portions which include a portion wound at an inside region of the transformer and a portion wound at an outside region of the transformer;

at least a portion of the other one of said primary winding and said secondary winding is wound between said at least two portions obtained by dividing the one of said primary winding and said secondary winding; and wherein at least a portion of said cavity of said bobbin is used as a space to dispose another member therein; and a loudspeaker, connected to said transformer, and including a sound-producing body having a piezoelectric body.

7. A loudspeaker device according to claim 6, wherein at least a portion of said loudspeaker is provided in said cavity of said bobbin.

8. A loudspeaker device according to claim 6, wherein said loudspeaker includes a supporting member, and said sound-producing body is mounted on said supporting member.

9. A loudspeaker device according to claim 8, wherein said supporting member is disk-shaped and includes a hole in a approximate central portion thereof.

10. A loudspeaker device according to claim 6, wherein said loudspeaker includes a horn to conduct sound waves transmitted from said sound-producing body, one end portion of said horn is inserted into said cavity of said bobbin, and said bobbin of said transformer is mounted on said horn.

11. A loudspeaker device according to claim 6, wherein said loudspeaker includes a horn to conduct sound waves transmitted from said sound-producing body, and a supporting member, said horn being mounted on said supporting member, one end portion of said horn is inserted into said cavity of said bobbin, and said bobbin of said transformer is mounted on said horn.

12. A loudspeaker device according to claim 11, wherein said loudspeaker further includes a plurality of input terminals connected to said sound-producing body, and each of said plurality of input terminals having a portion disposed between said horn and said supporting member.

* * * * *